US011851269B2

(12) United States Patent
Chen et al.

(10) Patent No.: US 11,851,269 B2
(45) Date of Patent: Dec. 26, 2023

(54) DREDGING DEVICE

(71) Applicant: SUZHOU TPRI ENER & ENVIRO TECH CO., LTD., Jiangsu (CN)

(72) Inventors: Min Chen, Jiangsu (CN); Xiaohua Wang, Jiangsu (CN); Baokang Chen, Jiangsu (CN); Junwu Zhao, Jiangsu (CN); Zhenfeng Mei, Jiangsu (CN); Xiaolei Xue, Jiangsu (CN); Xiaomin Peng, Jiangsu (CN); Shengjie Yu, Jiangsu (CN); Ruipeng Liu, Jiangsu (CN); Peng Zhao, Jiangsu (CN); Yiwen Ding, Jiangsu (CN); Jinyong Zhu, Jiangsu (CN); Sheng Yao, Jiangsu (CN); Zhucheng Wang, Jiangsu (CN); Hao Liang, Jiangsu (CN); Hui Wang, Jiangsu (CN)

(73) Assignee: SUZHOU TPRI ENER & ENVIRO TECH CO., LTD., Jiangsu (CN)

( * ) Notice: Subject to any disclaimer, the term of this patent is extended or adjusted under 35 U.S.C. 154(b) by 0 days.

(21) Appl. No.: 18/091,446

(22) Filed: Dec. 30, 2022

(65) Prior Publication Data

US 2023/0142514 A1 May 11, 2023

Related U.S. Application Data

(63) Continuation of application No. PCT/CN2021/115077, filed on Aug. 27, 2021.

(30) Foreign Application Priority Data

Jun. 1, 2021 (CN) ..... 202110606965.5

(51) Int. Cl.
*B65D 88/66* (2006.01)
*B65D 88/68* (2006.01)
(Continued)

(52) U.S. Cl.
CPC ..... *B65D 88/66* (2013.01); *B08B 7/02* (2013.01); *B08B 9/027* (2013.01); *B65D 88/68* (2013.01); *F23K 3/00* (2013.01); *B65D 2588/64* (2013.01)

(58) Field of Classification Search
CPC .... B65D 88/66; B65D 88/68; B65D 2588/64; B08B 7/02; B08B 9/027; F23K 3/00
See application file for complete search history.

(56) References Cited

FOREIGN PATENT DOCUMENTS

CN 104984963 A 10/2015
CN 105035570 A 11/2015
(Continued)

OTHER PUBLICATIONS

Written Opinion of the International Searching Authority for PCT/CN2021/115077 dated Feb. 25, 2022.
(Continued)

*Primary Examiner* — Frederick C Nicolas
(74) *Attorney, Agent, or Firm* — Schmeiser, Olsen & Watts, LLP

(57) ABSTRACT

A dredging device for dredging a pipe is provided including: a carrying frame, adapted to connected to a pipe; a shaking dredging unit including a first shaking plate and a second shaking plate, and the first shaking plate and the second shaking plate are arranged within the pipe; and a driving unit, connected to the carrying frame. The driving unit is connected to the first shaking plate and the second shaking plate for driving the first shaking plate and the second shaking plate to reciprocate to approach or move away from each other.

15 Claims, 4 Drawing Sheets

(51) Int. Cl.

| | |
|---|---|
| ***B08B 9/027*** | (2006.01) |
| ***F23K 3/00*** | (2006.01) |
| ***B08B 7/02*** | (2006.01) |

(56) References Cited

FOREIGN PATENT DOCUMENTS

| | | | | | |
|---|---|---|---|---|---|
| CN | 106185080 | A | * | 12/2016 | ..... B65D 88/28 |
| CN | 107054912 | A | | 8/2017 | |
| CN | 108792326 | A | * | 11/2018 | ..... B02C 18/08 |
| CN | 211600768 | U | | 9/2020 | |
| CN | 111842131 | A | * | 10/2020 | ..... B07B 1/343 |
| CN | 112079136 | A | | 12/2020 | |
| CN | 113634559 | A | * | 11/2021 | ..... B08B 9/027 |
| JP | 2009279529 | A | | 12/2009 | |

OTHER PUBLICATIONS

International Search Report for PCT/CN2021/115077 dated Feb. 25, 2022.

* cited by examiner

DREDGING DEVICE

CROSS-REFERENCE TO RELATED APPLICATIONS

This application is a continuation application to PCT/CN2021/115077, having a filing date of Aug. 27, 2021, which claims priority to Chinese Application No. 202110606965.5, having a filing date of Jun. 1, 2021, the entire contents both of which are incorporated herein by reference.

FIELD OF TECHNOLOGY

The following relates to the field of coal-fired power plants, in particular to a dredging device.

BACKGROUND

In the conventional art, for a boiler of a coal-fired power plant, when coal is poured into a coal hopper, a coal dropping pipe may sometimes be blocked due to excessive coal or debris entering the coal dropping pipe. At the same time, the coal dropping pipe is easy to be blocked because the coal is too moist and the coal is highly viscous, which causes the coal to easily stick to the coal dropping pipe, and the existed common method for the blocked coal dropping pipe is to use an air cannon to open the coal pipe, or beat it manually, which is very inconvenient, and a faster and more stable way is needed to solve the existing deficiencies.

SUMMARY

An aspect relates to a dredging device, which can be used for dredging coal blocking of a coal dropping pipe of coal-fired power plants.

To achieve the above purpose, a technical solution adopted by the present disclosure is:

a dredging device for dredging a pipe, comprising:

a carrying frame, adapted to connected to the pipe;

a shaking dredging unit, comprising a first shaking plate and a second shaking plate adapted to be arranged within the pipe;

a driving unit, connected to the carrying frame;

wherein, the driving unit is connected to the first shaking plate and the second shaking plate for driving the first shaking plate and the second shaking plate to reciprocate to approach or move away from each other.

The present disclosure can be arranged on the pipe, and dredge by shaking the dredging unit, during a coal dropping process, the first shaking plate and the second shaking plate approach or move away from each other and reciprocate, the reciprocating motion of the two shaking plates in the pipe can cause the movement of the coal when falling be more violent, so that the coal cannot fall slowly and stick to the pipe, thus reduce the possibility of coal blocking the pipe.

Another technical solution adopted by the present disclosure is:

a dredging device comprising a carrying frame, a shaking dredging unit, a stirring dredging unit, and a driving unit, wherein, the carrying frame is connected to a pipe;

the shaking dredging unit comprises a first shaking plate and a second shaking plate, the first shaking plate and the second shaking plate are adapted to be arranged within the pipe, and the driving unit is connected to the first shaking plate and the second shaking plate;

the stirring dredging unit comprises a turntable assembly and a stirring rod, the turntable assembly and the stirring rod are adapted to be arranged within the pipe, the turntable assembly is rotatably connected to the carrying frame, the stirring rod is connected to the turntable assembly, and the driving unit is connected to the turntable assembly;

the driving unit is connected to the carrying frame, and simultaneously drives the first shaking plate and the second shaking plate to reciprocate to approach or move away from each other, and the turntable assembly and the stirring rod to rotate;

the driving unit comprises a driving member, a shaking transmission assembly and a stirring transmission assembly, the shaking transmission assembly comprises a rack, a gear engaged with the rack, a shaking transmission rod and a pull rod, an output end of the driving member is connected to the rack to drive the rack to translate along its extension direction, and one end portion of the shaking transmission rod is rotatably connected to the carrying frame and is coaxially connected with the gear, the other end portion of the shaking transmission rod is rotatably connected with one end portion of the pull rod, and the other end portion of the pull rod is connected with the first shaking plate or the second shaking plate;

the stirring transmission assembly comprises a stirring transmission rod and a stirring rotation rod, an output end of the driving unit is rotatably connected with one end portion of the stirring transmission rod, and the other end portion of the stirring transmission rod is rotatably connected with the stirring rotation rod, the stirring rotation rod is fixedly connected with the turntable assembly, the stirring transmission rod is relatively perpendicular to the rotating shaft of the turntable assembly, and the stirring rotation rod is parallel to the rotating shaft of the turntable assembly.

The present disclosure can be arranged on the pipe, and dredge by shaking and stirring the dredging unit, the reciprocating motion of the two shaking plates in the pipe can cause the movement of the coal when falling be more violent, so that the coal cannot fall slowly and stick to the pipe; the rotation of the stirring rod can break up larger pieces of coal to make it fall smoothly, reducing the possibility of coal blocking the pipe. The present disclosure can be used on various pipes, which is easy to install, has a high degree of dredging automation, and effectively ensures a well dredging of pipes.

BRIEF DESCRIPTION

Some of the embodiments will be described in detail, with references to the following Figures, wherein like designations denote like members, wherein.

DETAILED DESCRIPTION

In the following, the technical solutions of the present disclosure are described clearly and completely in conjunction with the accompanying drawings, and apparently, the described embodiments are merely a part of the embodiments of the present disclosure, not all the embodiments. Based on the embodiments of the present disclosure, all other embodiments obtained by one of ordinary skill in the conventional art without creative work should fall within the protective scope of the present disclosure.

As shown in FIGS. 1, 2, 4 and 6, a dredging device for dredging a pipe 1, especially for dredging a coal blocking of a coal dropping pipe of the coal-fired power plant. In this embodiment, the pipe 1 takes the coal dropping pipe as an example, and the cross section of the coal dropping pipe is square. However, the device is not only limited to the coal dropping pipe, but can also be used for other pipe 1 which is easily blocked by coal, such as a pipe 1 for a coal hopper and a coal bunker.

The device comprises a carrying frame 9, a shaking dredging unit, a stirring dredging unit, a driving unit and a sealing cover 8, etc. The shaking dredging unit causes the coal blockage fall off by shaking and then dredges the pipe 1, and the stirring dredging unit causes the coal blockage fall off by stirring the coal blockage and then dredges the pipe 1, the driving unit is to drive the shaking dredging unit to shake and/or to drive the stirring dredging unit to stir. The carrying frame 9 is arranged on the pipe 1 to connect the device to the pipe 1, and the carrying frame 9 can be arranged within the pipe 1 or outside the pipe 1, the stirring dredging unit and the driving unit are connected to the carrying frame 9, and the shaking dredging unit and the stirring dredging unit are arranged within the pipe 1. In this embodiment, the carrying frame 9 is installed on the out wall of the pipe 1. The sealing cover 8 covers the carrying frame 9 and the driving unit inside.

Figure 3:
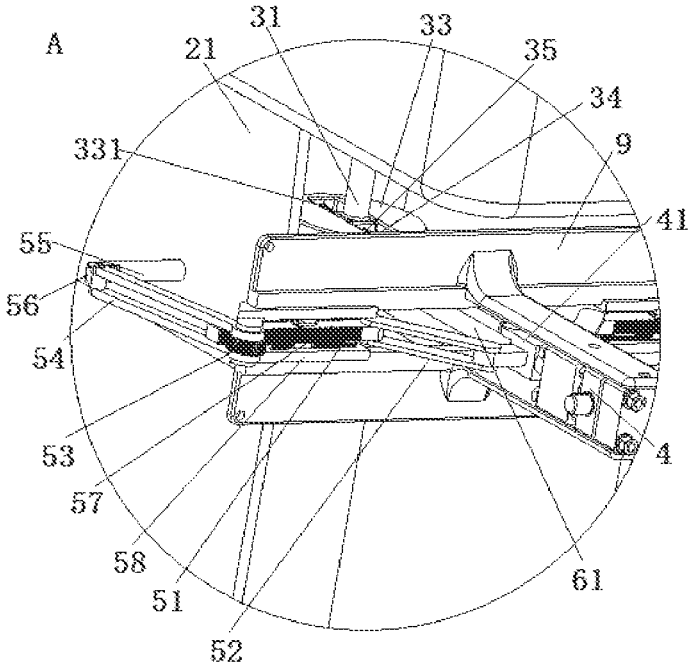
FIG. 3 is an enlarged schematic diagram of Part A in FIG. 2.
Figure 4:
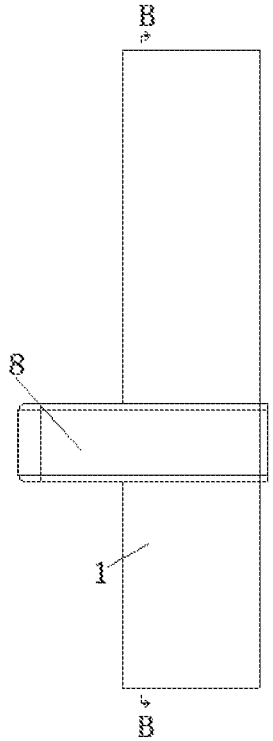
FIG. 4 is a front view of the device in an embodiment installed on the pipe.
Figure 8:
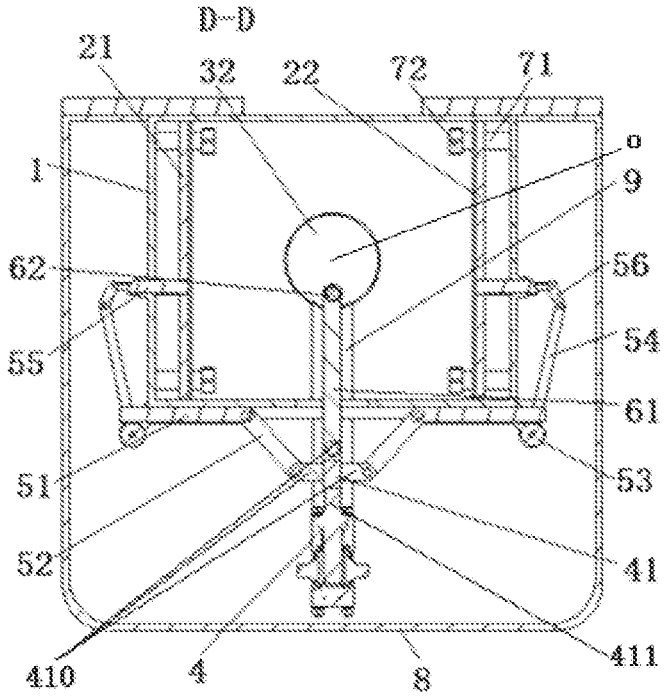
FIG. 8 is a cross-sectional view in the D-D direction in FIG. 6.

As shown in FIGS. 3 and 8, the driving unit comprises a driving member 4, a shaking transmission assembly and a stirring transmission assembly. An output end of the driving member 4 is provided with a connecting block 41, and the connecting block 41 has a plurality of ends 410 respectively connected to the respective shaking transmission assembly and stirring transmission assembly, the driving member 4 drives the shaking dredging unit to act through the shaking transmission assembly, and the driving member 4 drives the stirring dredging unit to act through the stirring transmission assembly. The driving member 4 is provided with a push rod 411 reciprocating with respect to the pipe 1, the connecting block 41 is arranged at the end portion of the push rod 411 and reciprocates on a straight line to go close to or away from the pipe 1 under the action of the push rod 411, and the driving part 4 is driven by electric or hydraulic pressure, that is, the driving member 4 may be a motor or a hydraulic cylinder or the like. The driving unit simultaneously drives the shaking dredging unit and the stirring dredging unit to perform the dredging work.

Figure 5:
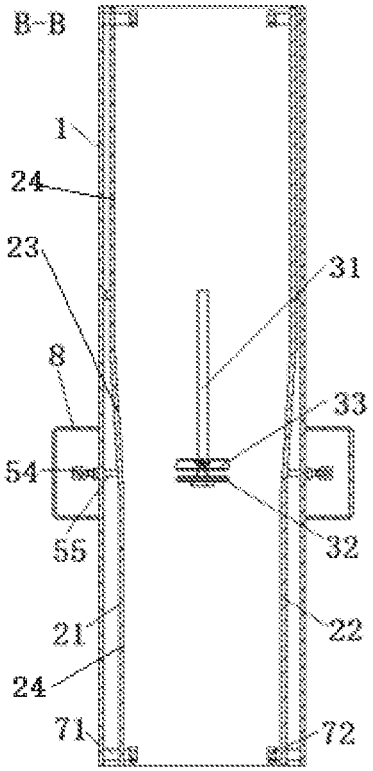
FIG. 5 is a cross-sectional view in the B-B direction in FIG. 4.
Figure 6:
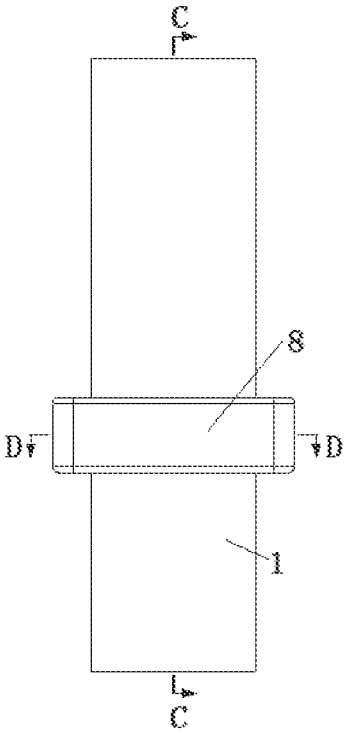
FIG. 6 is a side view of the device in an embodiment installed on the pipe.

As shown in FIGS. 3 and 5, the shaking dredging unit is connected with the driving member 4 through the shaking transmission assembly, and the shaking dredging unit comprises a first shaking plate 21 and a second shaking plate 22, the first shaking plate 21 and the second shaking plate 22 are respectively connected with the connecting block 41 on the output ends of the driving member 4 through a set of shaking transmission assemblies, and the shaking transmission assemblies are located symmetrically on two sides of the pipe 1, respectively. When used in the pipe 1, the first shaking plate 21 and the second shaking plate 22 are arranged opposite to each other, and the first shaking plate 21 and the second shaking plate 22 are simultaneously driven by the driving member 4 to reciprocate to approach or move away from each other. Each of the first shaking plate 21 and the second shaking plate 22 comprises an inclined plate 23 and a straight plate 24 which are integrally provided, two sides of the inclined plates 23 are the straight plates 24 that are parallel to each other, the extension direction of the straight plates 24 is consistent with the extension direction of the coal dropping pipe 1, and in the coal dropping pipe 1, the inclined plate 23 is inclined from top to bottom in a direction away from the inner wall of the pipe, as shown in FIG. 5.

The shaking transmission assembly comprises a rack 51, a rack draw rod 52, a gear 53 engaged with the rack 51, a shaking transmission rod 54, a pull rod 55, and a hinge block 56. One end portion of the rack draw rod 52 is rotatably connected to the connecting block 41 at one of the output ends of the driving member 4, and the other end portion is rotatably connected to the rack 51, as shown in FIG. 3. In this embodiment, the rack draw rod 52 is two relatively parallel rods, the connecting block 41 at one of the output ends of the driving member 4 is connected between the two rack draw rods 52, and the rack 51 is also connected between the two rack draw rods 52, so that the transmission connection drives the rack 51 to translate along the its extension direction. In this embodiment, the shaking transmission rod 54 is also two relatively parallel rods, one end portion of each of the two shaking transmission rods 54 is rotatably connected to the carrying frame 9 and is coaxially connected to the gear 53 (the rotating shafts between the shaking transmission rods 54 and the carrying frame 9, the gear 53 is rotatably connected to the carrying frame 9), the other end portion of each of the shaking transmission rods 54 is rotatably connected with one end portion of the hinge block 56, the other end portion of the hinge block 56 is rotatably connected with one end portion of the pull rod 55, and the other end portion of the pull rod 55 is fixedly connected to the first shaking plate 21 or the second shaking plate 22. The pipe 1 is provided with a hole through which the other end portion of the pull rod 55 is connected to the first shaking plate 21 or the second shaking plate 22, and specifically may be connected to the inclined plate of the first shaking plate 21 or the second shaking plate 22.

The carrying frame 9 is provided with a guide rail 57 and a guide slider 58 slidably arranged on the guide rail 57, and the rack 51 is connected to the guide slider 58, so that the rack 51 can connected more firmly, and the rack 51 can be limited and guided. In use: the connecting block 41 reciprocates in a straight line to drive the rack 51 to move, the rack 51 cooperates with and drives the gear 53 to rotate, and the gear 53 drives the shaking transmission rods 54 to rotate or swing to drive the pull rod 55 to move, so that the first shaking plate 21 and the second shaking plate 22 reciprocate to approach or move away from each other.

As shown in FIGS. 1, 2, 5, and 7, the device further comprises a shaking guide assembly, the shaking guide assembly is connected to the inner wall surface of the pipe 1, and the first shaking plate 21 and the second shaking plate 22 are respectively connected to the shaking guide assembly, each shaking plate can be provided with a plurality of shaking guide assemblies, the shaking guide assemblies are arranged at the corners of each shaking plate, and the first shaking plate 21 and the second shaking plate 22 maintain their reciprocating paths through the shaking guide assemblies. The shaking guide assembly comprises a guide rod 71 and a limit block 72, one end of the guide rod 71 is connected to the inner wall surface of the pipe 1 and the other end portion is provided with a limit block 72, the limit block 72 is threaded mounted on the guide rod 71 to facilitate subsequent cleaning and maintenance. The driving unit drives the first shaking plate 21 and the second shaking plate 22 to move within the range from one end portion to the other end portion of the guide rod 71, so as to guide and limit the movement of the first shaking plate 21 and the second shaking plate 22. The length of the guide rod 71 should not be too long, that is, the shaking amplitude of the shaking plates is not enough to make the coal drop between the shaking plates and the coal dropping pipe.

Figure 7:
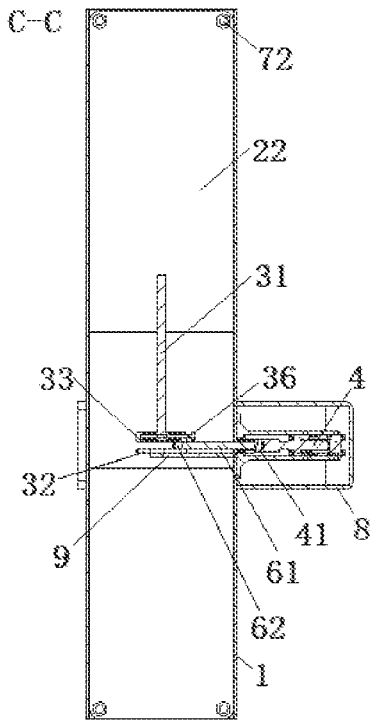
FIG. 7 is a cross-sectional view in the C-C direction in FIG. 6.

As shown in FIGS. 5, 7, and 8, the stirring dredging unit is connected with the driving member 4 through the stirring transmission assembly, the stirring dredging unit comprises a turntable assembly and a stirring rod 31, the turntable assembly is rotatably connected to the carrying frame 9, the stirring rod 31 is fixedly connected to the turntable assembly, the turntable assembly and the stirring rod 31 are arranged within the pipe 1, and the extension direction of the stirring rod 31 is consistent with the extension direction of the pipe 1 (in this embodiment, the stirring rod 31 extends toward the opening of the pipe 1 for material dropping), the driving member 4 drives the turntable assembly and the stirring rod 31 to rotate under the transmission of the stirring transmission assembly, the rotation of the stirring rod 31 can prevent the coal from blocking the pipe 1 when the coal drops, and at the same time, because the turntable assembly is rotating all the time, it is also possible to avoid coal dropping on the turntable assembly as much as possible. When in use, a slot is formed on the pipe 1 to facilitate the carrying frame 9 and the stirring transmission assembly inserting into the pipe 1, and the size of the slot is not enough to cause the coal inside the pipe 1 fall out from the slot.

The stirring transmission assembly comprises a stirring transmission rod 61 and a stirring rotation rod 62, one end portion of the stirring transmission rod 61 is rotatably connected with the connecting block 41 as the output end of the driving unit and the other end portion inserts into the pipe 1 and is rotatably connected with the stirring rotation rod 62, the stirring rotation rod 62 is fixedly connected with the turntable assembly, the stirring transmission rod 61 is relatively perpendicular to the rotating shaft between the turntable assembly and the carrying frame 9, the stirring rotating rod 62 is parallel to the rotation shaft o between the turntable assembly and the bearing frame 9 and all extend in the up-down direction, one output end of the driving member 4 moves reciprocatingly in a straight line to pull the stirring transmission rod 61 to swing, thereby driving the stirring rotation rod 62 to rotate around the rotation shaft of the turntable assembly, and the stirring transmission rod 61 is equivalent to a swing arm pulling the turntable assembly to rotate around the rotation shaft o, that is, the stirring rotation rod 62 is eccentrically arranged relative to the rotation shaft o of the turntable assembly, and the stirring rotation rod 62 does not coincide with the rotation shaft of the turntable assembly.

The turntable assembly comprises a first turntable 32 and a second turntable 33 that rotate coaxially, the first turntable 32 and the second turntable 33 are connected to the stirring transmission rod 61 through the stirring rotation rod 62 in a transmission manner, the first turntable 32 may be rotatably connected to the carrying frame 9 via the rotation shaft o, and the stirring rod 31 is connected to the second turntable 33.

The stirring dredging unit further comprises a stirring rod position adjustment assembly for adjusting the position of the stirring rod 31 on the second turntable 33. The stirring rod position adjustment assembly comprises an adjusting slide rail 34, an adjusting slider 35, and an adjusting driving member 36. In this embodiment, the stirring rod position adjustment assembly is arranged on the second turntable 33, and can also be arranged on the first turntable 32 in practical applications. The adjusting slide rail 34 is arranged on the second turntable 33, the adjusting slider 35 is slidably arranged on the adjusting slide rail 34, and the adjusting slider 35 is connected with the stirring rod 31. As shown in FIG. 3, the stirring rod 31 is arranged on the adjusting slider 35, and the movement of the adjusting slider 35 drives the stirring rod 31 to move together, according to different coal dropping speeds or coal types, the radius of the stirring rod 31 rotating around the rotation shaft of the turntable assembly is changed to adjust the magnitude of the eccentric stirring of the stirring rod 31. Specifically, the second turntable 33 is provided with a limit slot 331, and the adjusting slide rail 34 is arranged in the limit slot 331, and the stirring rod 31 may also pass through the limit slot 331 to connect and cooperate with the first turntable 32, the first turntable 32 plays the role of driving the stirring rod 31 to rotate, and the second turntable 33 plays the role of stabilizing the connection of the stirring rod 31. The adjusting driving member 36 is connected with the adjusting slider 35 for driving the adjusting slider 35 to move on the adjusting slide rail 34, the output end of the adjusting driving member 36 has a threaded rod, and the threaded rod extends along the length direction of the adjusting slide rail 34 and penetrates through the adjusting slider 35, the rotation of the threaded rod moves the adjusting slider 35 threaded matched with the threaded rod, thereby adjusting the position of the stirring rod 31, and a motor can be used for the adjusting driving member 36. A protective shell is connected to the turntable assembly, and the protective shell covers the outer side of the adjusting driving member 36 to prevent the adjusting driving member 36 from being damaged by falling coal.

In this embodiment, the rotational connections are all in the form of hinges.

Figure 1:
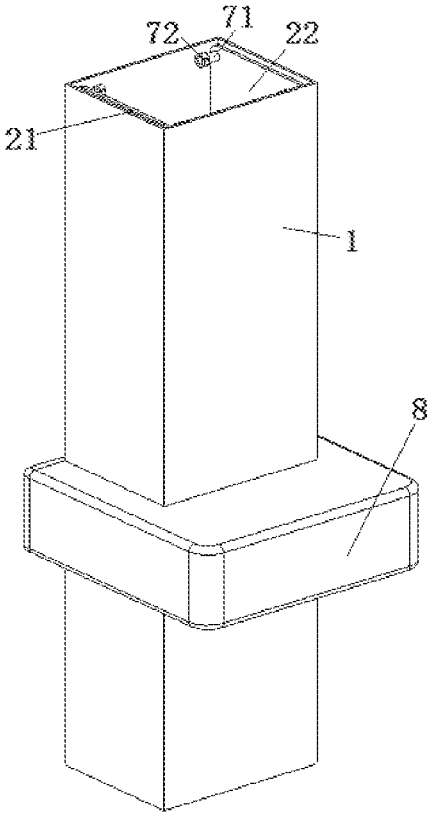
FIG. 1 is a three-dimensional schematic diagram of the device in an embodiment installed on a pipe.
Figure 2:
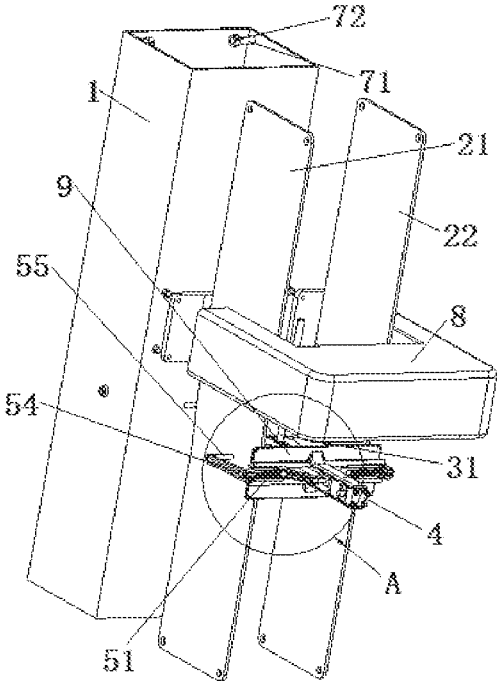
FIG. 2 is a three-dimensional schematic diagram of the device in an embodiment removed from the pipe.

The working principle of this embodiment is described in detail below:

As shown in FIGS. 2, 3 and 8, the dredging device is installed on the coal dropping pipe through the carrying frame 9, and during operation: the driving member 4 drives the connecting block 41 to reciprocate along a straight line, and the connecting block 41 drives the rack draw rod 52 and the stirring transmission rod 61 to swing, the rack draw rod 52 drives the rack 51 to move to control the gear 53 to rotate, the gear 53 rotates to drive the shaking transmission rod 54 to swing, the shaking transmission rod 54 drives the pull rod 55 to reciprocate in a straight line through the cooperation of the hinge block 56, and finally move the first shaking plate 21 and the second shaking plate 22 under the restriction of the guide rod 71; the stirring transmission rod 61 pulls the first turntable 32 and the second turntable 33 to rotate coaxially through the stirring rotation rod 62, and the stirring rod 31 is driven by the first turntable 32 and the second turntable 33 to stir around the shaft axis o of the turntable assembly, and according to the different blocking conditions, the stirring force is changed by controlling the eccentricity of the stirring rod 31 by the stirring adjustment assembly.

Although the present invention has been disclosed in the form of embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

What is claimed is:

1. A dredging device for dredging a pipe comprising:

a carrying frame configured to connected to the pipe;

a shaking dredging unit, comprising a first shaking plate and a second shaking plate, and the first shaking plate and the second shaking plate are arranged within the pipe;

a driving unit connected to the carrying frame; and a stirring dredging unit;

wherein the driving unit is connected to the first shaking plate and the second shaking plate for driving the first shaking plate and the second shaking plate to reciprocate to approach or move away from each other;

wherein the stirring dredging unit comprises a turntable assembly and a stirring rod, the turntable assembly and the stirring rod being arranged within the pipe, further wherein the turntable assembly is rotatably connected to the carrying frame, the stirring rod is connected to the turntable assembly, an extension direction of the stirring rod is consistent with an extension direction of the pipe, and the driving unit is connected to the turntable assembly for driving the turntable assembly and the stirring rod to rotate;

wherein the stirring dredging unit further comprises a stirring rod position adjustment assembly, and the stirring rod position adjustment assembly comprises an adjusting slide rail, an adjusting slider, and the adjusting slider is arranged on the turntable assembly, the adjusting slider is slidably arranged on the adjusting slide rail, and the adjusting slider is connected to the stirring rod.

2. The dredging device according to claim 1, wherein the driving unit simultaneously drives the first shaking plate and the second shaking plate to reciprocate to approach or move away from each other, and drives the turntable assembly and the stirring rod to rotate.

3. The dredging device according to claim 1, wherein the driving unit comprises a driving member and a stirring transmission assembly, the stirring transmission assembly is connected to an output end of the driving member, and the stirring transmission assembly comprises a stirring transmission rod and a stirring rotation rod, one end portion of the stirring transmission rod is rotatably connected with the output end of the driving unit and the other end portion of the stirring transmission rod is rotatably connected with the stirring rotation rod, the stirring rotation rod is fixedly connected with the turntable assembly, the stirring transmission rod is relatively perpendicular to a rotating shaft of the turntable assembly, and the stirring rotation rod is parallel to the rotating shaft of the turntable assembly.

4. The dredging device according to claim 1, wherein the stirring rod position adjustment assembly comprises an adjusting driving member, and the adjusting driving member is connected with the adjusting slider for driving the adjusting slider to move within the adjusting slide rail.

5. The dredging device according to claim 4, wherein an output end of the adjusting driving member has a threaded rod, the threaded rod extends along a length direction of the adjusting slide rail and penetrates through the adjusting slider, and the threaded rod is screw-thread fitted with the adjusting slider.

6. The dredging device according to claim 1, wherein the turntable assembly comprises a first turntable and a second turntable which rotate coaxially, and the first turntable and the second turntable are connected through the driving unit, the first turntable is rotatably connected to the carrying frame, and the stirring rod is connected to the second turntable.

7. The dredging device according to claim 6, wherein the stirring dredging unit further comprising a stirring rod position adjustment assembly, and the stirring rod is connected to the stirring dredging unit; the second turntable is provided with a limit slot, and the stirring rod position adjustment assembly is arranged in the limit slot of the second turntable.

8. The dredging device according to claim 1, wherein the driving unit comprises a driving member and a shaking transmission assembly, the shaking transmission assembly is connected to an output end of the driving member, and the first shaking plate and the second shaking plate are respectively connected with the output end of the driving unit through a set of shaking transmission assemblies, respectively.

9. The dredging device according to claim 8, wherein the shaking transmission assembly comprises a rack, a gear engaged with the rack, a shaking transmission rod and a pull rod, an output end of the driving member is connected to the rack in a transmission manner to drive the rack to translate along an extension direction, one end portion of the shaking transmission rod is rotatably connected to the carrying frame and is coaxially connected with the gear, the other end portion of the shaking transmission rod is rotatably connected with one end portion of the pull rod, and the other end portion of the pull rod is connected with the first shaking plate or the second shaking plate.

10. The dredging device according to claim 9, wherein the shaking transmission assembly further comprises a rack draw rod, and one end portion of the rack draw rod is rotatably connected to the output end of the driving member, and the other end portion is rotatably connected to the rack.

11. The dredging device according to claim 9, wherein the shaking transmission assembly further comprises a hinge block, and one end portion of the hinge block is rotatably connected to the shaking transmission rod, and the other end portion is rotatably connected to one end portion of the pull rod.

12. The dredging device according to claim 9, wherein the carrying frame is provided with a guide rail and a guide slider, the guide slider is slidably arranged on the guide rail, and the rack is connected to the guide slider.

13. The dredging device according to claim 1, wherein further comprising a shaking guide assembly, and the shaking guide assembly is connected to an inner wall surface of the pipe, and the first shaking plate and the second shaking plate are respectively connected to the shaking guide assembly.

14. The dredging device according to claim 13, wherein the shaking guide assembly comprises a guide rod and a limit block, one end of the guide rod is connected to the inner wall surface of the pipe and the other end portion is provided with the limit block, and the first shaking plate and the second shaking plate move within a range from one end portion to the other end portion of the guide rod.

15. The dredging device according to claim 1, further comprising a sealing cover covering the carrying frame and the driving unit inside.

* * * * *